US005785488A

United States Patent [19]

Raschke et al.

[11] Patent Number: 5,785,488

[45] Date of Patent: Jul. 28, 1998

[54] APPARATUS FOR SORTING MAIL AND THE LIKE

[75] Inventors: Josef Raschke, Pliening; Rudolf Schuster, Kirchheim, both of Germany

[73] Assignee: Siemens Aktiengesellschaft, Munich, Germany

[21] Appl. No.: 765,797

[22] PCT Filed: Jul. 11, 1995

[86] PCT No.: PCT/DE95/00908

§ 371 Date: Jan. 14, 1997

§ 102(e) Date: Jan. 14, 1997

[87] PCT Pub. No.: WO96/02448

PCT Pub. Date: Feb. 1, 1996

[30] Foreign Application Priority Data

Jul. 14, 1994 [DE] Germany ..... 44 24 944.6

[51] Int. Cl.[6] ..... B65H 3/08

[52] U.S. Cl. ..... 414/798.9; 271/31.1; 414/737

[58] Field of Search ..... 271/31.1; 414/737, 414/798.9, 917

[56] References Cited

U.S. PATENT DOCUMENTS

| | | | |
|---|---|---|---|
| 2,698,699 | 1/1955 | Skillman . | |
| 4,087,171 | 5/1978 | Yano . | |
| 4,486,013 | 12/1984 | Vander Syde | 271/107 |
| 4,566,846 | 1/1986 | Cartwright | 414/737 X |
| 4,735,600 | 4/1988 | Drewke et al. | 493/314 |
| 4,881,934 | 11/1989 | Harston et al. | 414/737 X |
| 5,019,207 | 5/1991 | McCoy | 414/737 X |
| 5,029,834 | 7/1991 | Boldrini et al. | 271/11 |
| 5,234,314 | 8/1993 | Ganz | 414/798.9 X |
| 5,379,992 | 1/1995 | Holmes et al. | 271/31.1 X |
| 5,503,519 | 4/1996 | Schwetz et al. | 414/737 X |

FOREIGN PATENT DOCUMENTS

| | | |
|---|---|---|
| 0 234 228 | 9/1987 | European Pat. Off. . |
| 25 47 132 | 5/1977 | Germany . |
| 33 20 887 | 2/1984 | Germany . |
| 33 17 073 | 11/1984 | Germany . |
| 36 06 093 | 8/1987 | Germany . |
| 2 199 567 | 7/1988 | United Kingdom . |

*Primary Examiner*—Janice L. Krizek
*Attorney, Agent, or Firm*—Hill & Simpson

[57] ABSTRACT

The apparatus comprises a magazine (M) for the acceptance of the stacked unit load and for offering the unit load in an upper fetching position (A) of the stack, a guide profile (FP) of the magazine (M) that is at least approximately L-shaped in crossection and that is arranged inclined such that the unit load lies against both legs of the guide profile, and a rotor (R) that carries at least one suction grab (SG) that is adjustable in radial direction and swivellably arranged, and a conveyor (F) for the acceptance and further-transport of the separated unit load, whereby magazine (M), rotor (R) and conveyor (F) are aligned such relative to one another in terms of their spatial position that the suction grab (SG) can seize the unit load respectively offered in the fetching position (A) of the magazine (M) and transfer it to the conveyor (F) after a rotation of the rotor(R).

29 Claims, 5 Drawing Sheets

APPARATUS FOR SORTING MAIL AND THE LIKE

BACKGROUND OF THE INVENTION

Machine readable postal zip codes indicated on mailings such as letters, post cards, packages and the like as identifier for a place, a delivery area, a P.O. box or a bulk recipient enable a fast distribution of the mail by machine. The sorting of incoming mail shipments ensues, for example, with the assistance of controllable unit load carriers that are loaded with a respective mail shipment in specific loading locations and that then deliver this mail shipment to a sorting container allocated to the respective postal zip code or to a corresponding sorting bay. Since the sorting containers or sorting bays can be arranged in different levels, the unit load carriers circulating at conveyor devices must also potentially be able to bridge different heights. After delivering the mail shipment to the allocated sorting container or the allocated sorting bay, the empty unit load carriers can be loaded again with a mail shipment when they pass a loading location. The loading of the unit load carriers ensues, for example, with the assistance of a circulating impeller wheel whose blades form cells that pick up the unit load that has already been separated and arrives on a conveyor means and deliver it to the circulating unit load carriers. The separation and the transfer of the unit load to the conveyor means leading to the impeller wheel must thereby be undertaken with a relatively high precision adapted to the processing speed of the overall sorting means.

DE-A-36 06 093 or, respectively, the corresponding EP-A-0 234 228 discloses an apparatus for separating and erecting folding boxes that has a supply magazine for folding boxes, a removal device with circulating suction grabs, an endless conveyor means with dogs and nozzles that are arranged to the side of the conveyor means for inflating the conveyed folding boxes. The suction grabs successively pull the folding boxes from the magazine in the direction of the extent of the folding boxes and transfer these to the conveyor means lying flat on an arcuate path. Arcuately curved guide rails are allocated to the rotational path of the suction grabs behind the magazine for guiding the chains of the conveyor device and the folding boxes in the arcuate path.

Given the apparatus described above, the magazine is placed at an angle of about 45° relative to the horizontal and has a floor, two sidewalls and two rods limiting the front side at which the stack of folding boxes is supported. A retainer nose that can be moved up and down in clocked fashion is allocated to the front end of the floor, this retainer nose retaining the folding box offered in a lower fetching position of the magazine at the lower edge thereof. For removing the folding box offered in the lower fetching position of the magazine, the folding box is seized by the suction grabs and is pulled obliquely down from the stack over the retainer and sliding on the rods.

DE-A-2 547 132 discloses a rotation conveyor means that comprises a supply magazine for cartons or similar flat articles, a removal means having two suction grabs rotating at a rotor and an endlessly circulating conveyor belt having compartments arranged in uniform division for accepting the separated cartons. Here, too, the magazine is placed at an angle of about 45° relative to the horizontal and has a floor and two sidewalls. Two retainer plates on which the stack of cartons is supported are arranged at the front end of the magazine. The carton respectively offered in a lower fetching position of the magazine is then seized by a suction grab of the removal means, is pulled off from the stack over the front edge of the floor, is conveyed on a flat, arcuate path to the conveyor belt and is transferred to one of the compartments thereat. The flat, arcuate path of the suction grab derives in that the rotor turns not only around its own axis but, as a component part of a planetary gear, also turns around a second axis aligned parallel to the rotor axis.

DE-C-3 317 073 discloses a supply magazine for the acceptance of stackable goods that comprises a guide profile for the lateral guidance of the goods stacked on top of one another and a removal device for ejecting the respectively bottom item, whereby the guide profile is slanted such that the goods lie against two legs of the guide profile aligned L-shaped relative to one another. Due to the slant of the guide profile in two directions, an all-sides guidance of the goods can be foregone. The necessity of matching the size of the supply magazine to the size of the respective goods, however, is thereby also eliminated.

An object of the present invention is to provide for separating and transferring unit loads to a conveyor means that is also suitable for unit loads having different formats and different thicknesses. An embodiment of the device is thereby also particularly suited for the separation and distribution of items such as thin letters.

SUMMARY OF THE INVENTION

The aforementioned object is achieved by an apparatus according to the present invention. This apparatus may be used for separating and distributing unit loads of many types onto a conveyor. An apparatus according to an embodiment of the invention includes a magazine adapted for storing and guiding a stack of unit loads such that an endmost unit load in said stack is in an upper fetching position. The magazine has a generally L-shaped guide profile and is fixed in an inclined manner such that the stack lies against two sides of the L-shaped guide profile. A rotor is provided which is rotatably moveable and which carries at least one suction grab. The suction grab is radially displaceable relative to the rotor for controlled positioning. Also, the suction grab is swivellably mounted relative to the rotor so that it self-adjusts against the unit load for picking it up. The suction grab is adapted for suctionally grasping a next-available unit load from the fetching position. A moveable conveyor is located near the magazine onto which the suction grab releases the fetched unit load. The magazine, rotor and conveyor are positioned relative to one another such that the suction grab can seize the unit load in the fetching position of the magazine while the rotor is rotating and transfer it to the conveyor.

An inventive apparatus can be utilized for separating and distributing postal matter to a sorting means in public post offices or in the mail centers of large companies. Over and above this, however, a preferred embodiments of the invention can also be utilized for comparable tasks in, for example, warehouse systems or automatic commissary units wherein a stackable unit load is to be separated and transferred to a conveyor means.

The invention is based on the perception that a suction grab pivotably and radially adjustably attached to a rotor can grasp the unit load offered in an upper fetching position of a magazine and, after an appropriate rotation of the rotor, transfer it to a conveyor means insofar as the magazine, the rotor and the conveyor means are appropriately aligned relative to one another in terms of their spatial position. By offering the unit load in an upper fetching position, a pick-up action by the suction grabs is facilitated on the one hand, and, on the other hand, the removal of the unit load from the magazine is made independent of the height and the weight of the stack respectively located in the magazine.

For reliable separating and transfer, it is important that the unit load is reliably held by the suction grab on the entire path between the grasping in the fetching position of the magazine and the transfer to the conveyor means. In particular it is important that an ejection that is dependent on the shape and mass of the unit load can be foregone. Moreover, the transport of the unit load between the upper fetching position of the magazine and the conveyor means can be promoted by the influence of the force of gravity. The L-shaped guide profile enables a simple and fast loading of the storage and guide magazine with a stack of unit loads. A stack formation is enabled by the seating of the unit load at the two legs of the guide profile even given different sizes or formats of the unit load. Moreover, the seating against the two legs of the guide profile in the upper fetching position defines a location independently of size or format of the unit load at which the suction grab can seize the next available unit load. It must also be emphasized that the pressure of the remaining stack does not press on the unit load offered in the upper fetching position, that unit loads having different thicknesses can also be separated due to the upper fetching position, and that retainer mechanisms such as, for example, the retainer noses disclosed by DE-A-36 06 093 that are susceptible to malfunction can also be foregone as a result of the upper fetching position.

According to an embodiment of the invention an angle of about 90° between the two sides of the L-shaped guide profile is preferred in view of the usually rectangular shape of the unit load.

An embodiment of the present invention includes a retainer means fixedly mounted relative to the magazine. This retainer is adapted for releasably holding the endmost unit load in the stack, i.e., the unit load in the fetching position, until it is seized by the suction grab. In an embodiment, the retainer includes one or more flexible retainer strips which are biased against the unit load. The retainer, enables a reliable stop of the unit load offered in the fetching position of the magazine. On the other hand, however, the retainer means does not impede an intentional removal of the unit load offered in the fetching position by the suction grab.

An embodiment of the invention includes a guide fixedly mounted relative to the magazine for guiding the unit load seized by the suction grab as it is carried from the fetching position to the conveyor. This guide may be a smooth rod along which the seized unit load slides as it is moved by the suction grab.

In an embodiment, the conveyor is a belt conveyor. Such an embodiment, makes a gentle and dependable further-transport of the separated unit load possible with simple means.

In an embodiment, the suction grab is mounted to the rotor so that the suction grab is swivellable in tangential direction relative to a direction of rotation of the rotor. Such a moveable mounting; enables a flexible adaptation of the suction grab to the surface of the unit load offered in the fetching position of the magazine that is to be grabbed and to the conveying plane of the conveyor means that accepts the unit load.

In an embodiment, at least two suction grabs are mounted to the rotor. Such an embodiment with multiple suction grabs increases the speed and transporting capacity of the apparatus overall.

With this configuration, one suction unit can seize the unit load offered in the fetching position from the magazine. The second suction unit provides additional suction force as the unit load is rotated and lifted from the magazine. The rotation and the lifting action of the suction grab creates a torque and an additional force which the second suction unit accommodates.

In an embodiment, the suction grab includes two elastic suction units which seal against and thereby seize the unit load.

An embodiment of the apparatus provides that the suction grab is movably mounted to the rotor by a linkage. This enables a radial adjustment and a tangential swivel of a suction grab attached to the rotor with little outlay. According to, a related embodiment, the linkage includes two parallel articulated arms of equal length, each of said arms having one end pivotably mounted to the rotor and the other end pivotably mounted to the coupling. By such a linkage, a parallel guidance of the suction grab via two articulated arms of equal length is thereby preferred.

According to an embodiment, a relative motion between coupling and rotor and, thus, the radial adjustment and tangential swivel of the suction grab can be controlled with relatively little outlay via a cam drive.

In an embodiment, the cam drive includes a cam plate which is secured adjacent to the rotor. Advantageously, the cam drive further includes an angle lever secured to one of the articulated arms with a cam follower or roller mounted on the angle lever. The roller runs in a channel disposed in the cam plate when the rotor rotates so that the tangential pivoting of the linkage (and thus the suction grab) relative to the rotor is controlled by the shape of the cam. This motion is regularly repeated at each rotation of the rotor. In a particularly advantageous embodiment, this cam plate is adjustably secured relative to the rotor. Such an arrangement permits, an especially simple and exact adjustment of the suction grab to the fetching position of the magazine.

In an embodiment, the articulated arms are generally radially extended relative to said rotor when seizing a unit load in the fetching position. Advantageously, when, the two articulated arms are extended when grasping a unit load in the fetching position of the magazine, then the withdrawal of the respective unit load from the stack can be considerably facilitated by a radial retraction of the suction grab as the rotor continues to turn.

Similarly, in an embodiment, the two articulated arms are generally radially extended relative to the rotor upon transfer of the unit load to the conveyor.

Due to the greater radius of the stretched articulated arms and due to the stretching motion of the articulated arms themselves, such a motion effects an increase in the speed of the suction grab and, thus, an approach of the speed of the unit load to be delivered to the speed of the conveyor means that accepts the unit load.

In an embodiment, the magazine and the rotor are positioned and aligned relative to one another such that, when seizing the unit load, the suction grab has its suction face aligned approximately parallel to the surface of the unit load to be seized. This configuration provides an advantage in that it; enables a reliable seizing of the unit load in the fetching position of the magazine.

In an embodiment, the rotor and the conveyor are positioned relative to one another such that, when transferring the unit load to the conveyor, the suction grab has its suction face aligned approximately parallel to the conveying plane of the conveyor. This enhances the reliability of the seizing and transferring of the unit load.

Furthermore, in an embodiment, the rotor rotates on an axis aligned obliquely relative to a conveying direction of the conveyor. Additionally, the axis may be inclined obliquely relative to a conveying plane of the conveyor. These measures further enhance the reliability of the apparatus.

In an embodiment, the magazine and the conveyor means are relatively positioned to optimize; an attitudinally correct transfer of the unit load to the conveyor means. As a result thereof, an automatic recognition of the coding applied to the unit load and further handling of the unit load in the following sorting means are further facilitated.

In an embodiment, the conveyor has a plurality of regular divisions, and wherein a speed of the conveyor means and a speed of the rotor are matched to one another such that the transfer of the unit load to the conveyor means ensues at a whole multiple of the division of the conveyor. Such an embodiment; enables a matching of the overall apparatus for separating and for transferring unit load to a division of the conveyor means that accepts the unit load. Given employment of, for example, two or three apparatus, one apparatus then only occupies every second or, respectively, third division of the conveyor means. Moreover, the apparatus can also be matched to a non-uniform division of a conveyor means.

Additional features and advantages of the present invention are described in, and will be apparent from, the detailed description of the preferred embodiments and from the drawings.

Figure 5:
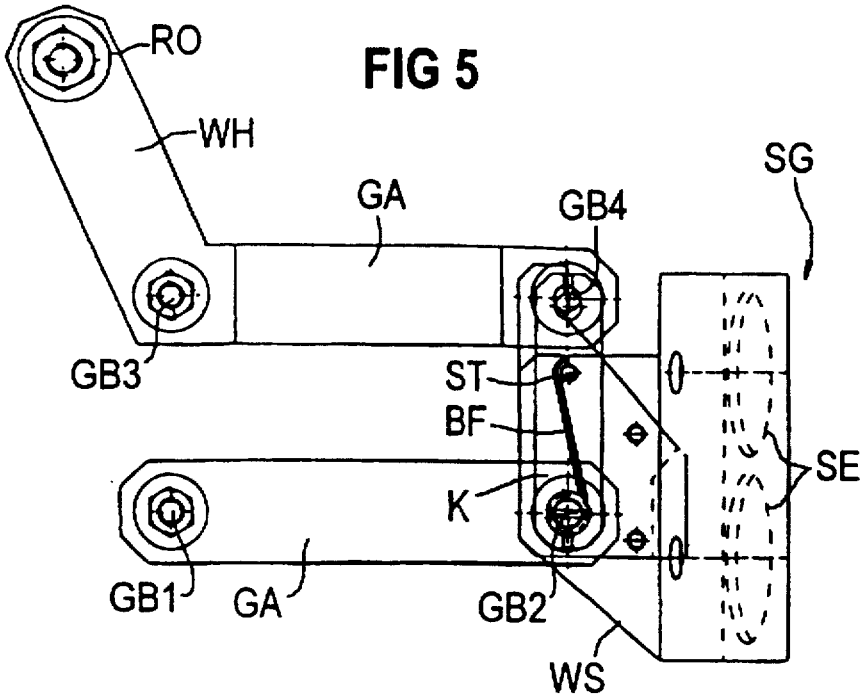
FIG. 5 is a front view of the suction grab attached to a four-pin linkage from the embodiment illustrated in FIG. 1.

DETAILED DESCRIPTION OF THE PREFERRED EMBODIMENTS. arms of the four-bar chain shown in FIG. 5.

Figure 1:
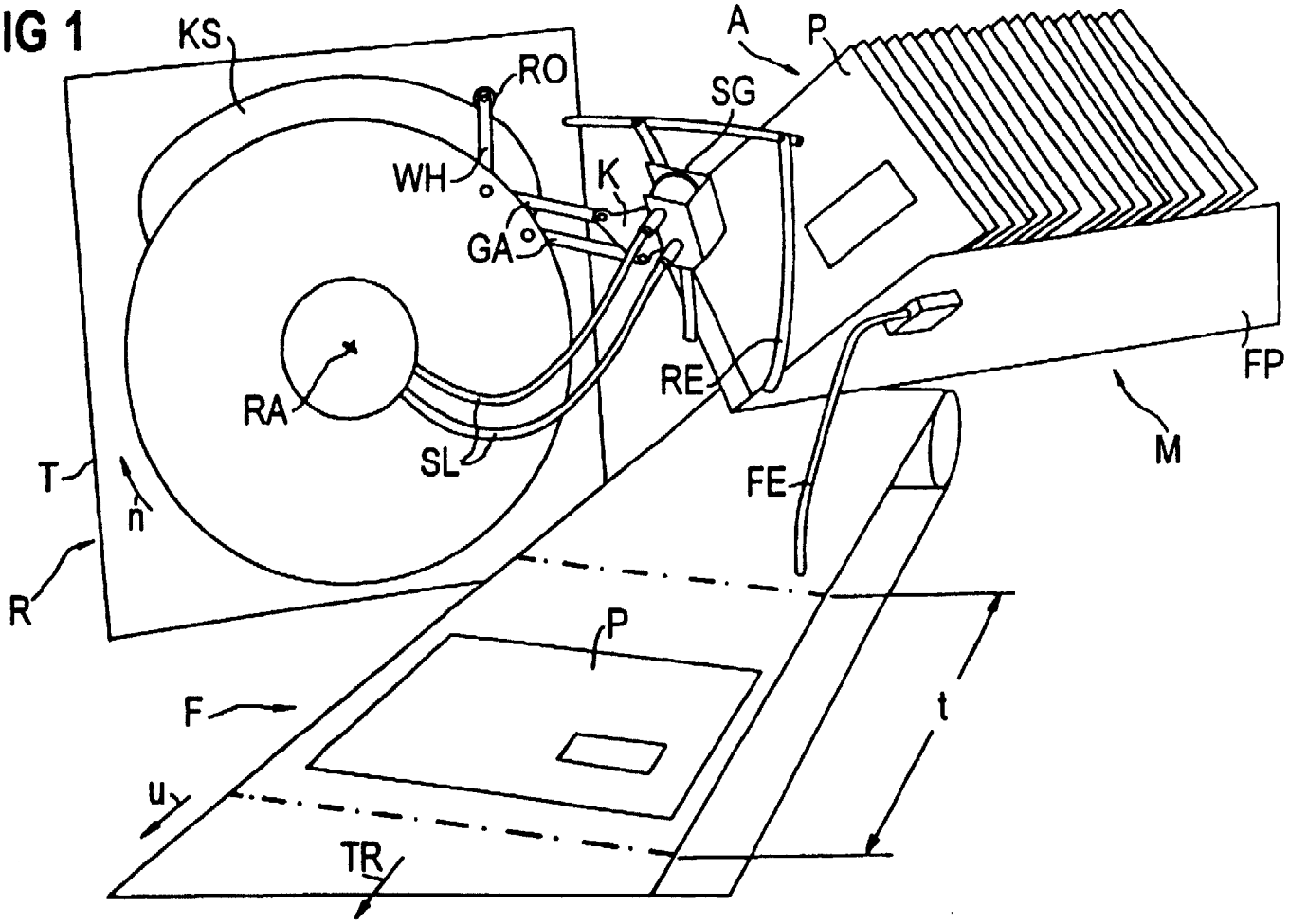
FIG. 1 is a schematic perspective view of an apparatus for separating and distributing postal matter according to an embodiment of the invention shortly before the seizing of a letter offered in the magazine.

FIG. 1 shows a highly simplified, schematic illustration of an apparatus for separating and distributing discrete unit loads, such as postal matter P, to a conveyor F. The acceptance of the postal matter P shown here in the form of letters, ensues in the L-shaped guide profile FP of a storage and guide magazine M. The inclination of the guide profile FP ascending toward the conveyor F is thereby selected such that the stacked postal matter P lies against both legs of the guide profile FP. The offering of the postal matter P in the magazine M for the separating ensues in an upper fetching position A. A retainer RE includes two thin leaf springs attached to a retainer rod in the illustrated exemplary embodiment. This retainer RE retains the postal matter P offered in the fetching position A for the separating. A guide FE is proceded which includes a curved rod directed toward the conveyor and whose function is explained later is also secured to the guide profile FP.

A suction grab SG is attached to a rotor R in a radially adjustable and tangentially swivellable manner. The suction grab SG is approaching the fetching position A at the point in time shown in FIG. 1. The suction grab SG is adapted to seize the postal matter P offered in the fetching position A. The suction grab SG is connected to a rotor R attached to a stationary carrier T. The rotor R turns clockwise at the speed n around the rotor shaft RA indicated by a cross. The hose conduits with which the suction grab SG is attached to a vacuum source (not shown in detail in the drawing) are referenced SL. The radial adjustability and the tangential swivel of the suction grab SG are enabled by a four-pin linkage having a coupling K to which the suction grab SG is secured. The coupling K is in turn connected via two articulated arms GA of equal length to the rotor R, whereby the upper articulated arm GA in the illustration according to FIG. 1 is rigidly connected to an angle lever WH. The free end of this angle lever WH carries a roller RO that runs at the outer circumference of a cam plate referenced KS. The cam plate KS thus controls the radial adjustment and the tangential swivel of the suction grab SG.

The conveyor F that accepts the separated postal matter P is illustrated in the exemplary embodiments as a belt conveyor whose conveyor belt (not referenced in detail) moves at the speed u in the conveying direction indicated with an arrow TR. Cross ribs (indicated with dot-dash lines in FIG. 1); on the conveyor belt in FIG. 1 create a division t for the acceptance and the further-transport of the postal matter P. The speed u of the conveyor means F and the speed n of the rotor R are matched to one another such that a transfer of the postal matter P to the conveyor means F ensues at every division t or a respective, whole multiple of the division t of the conveyor means F.

As was already mentioned, the suction grab SG is just approaching the upper fetching position A of the magazine M at the point in time shown in FIG. 1. As the rotor R continues to turn, the suction grab SG then reaches the position shown in FIG. 2 in which the two articulated arms GA are fully extended. In this position, moreover, a suction face of the suction grab SG is aligned parallel to a surface of the postal matter P offered in the upper fetching position A that is to be grabbed. This alignment of the suction grab SG effected by the control of the cam plate KS creates optimum conditions for the reliable seizing of the postal matter P offered in the upper fetching position A. For seizing the postal matter P, two suction units (referenced SE) of the suction grab SG are connected via the afore-mentioned hose conduits SL to the vacuum source.

Figure 2:
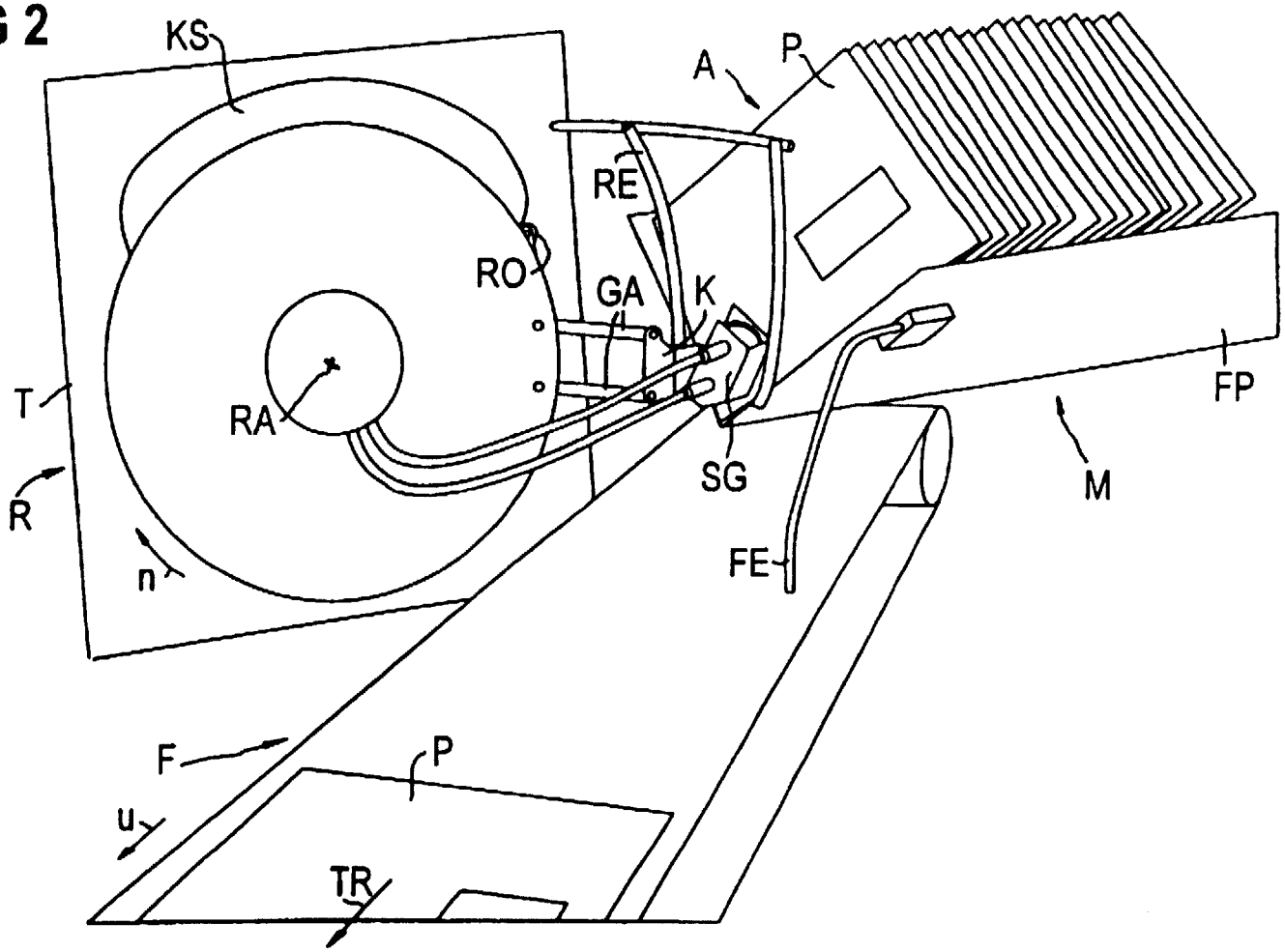
FIG. 2 is a schematic perspective view of the apparatus of FIG. 1 when seizing the letter.
Figure 3:
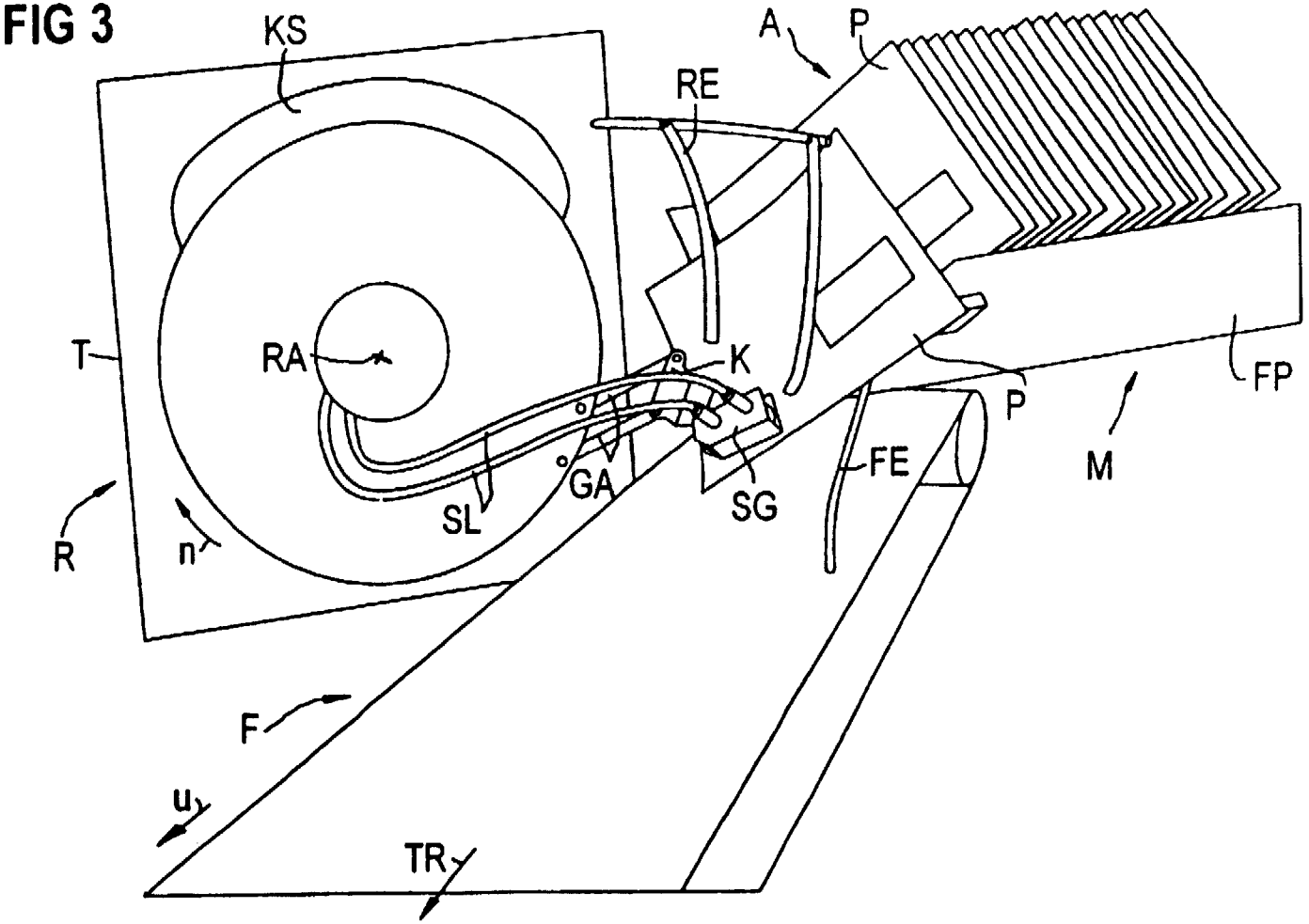
FIG. 3 is a schematic perspective view of the apparatus of FIG. 1 when removing the letter from the magazine.

After the SG seizes the postal matter P offered in the fetching position A as shown in FIG. 2, the rotor R continues to turn and, in collaboration with the cam plate KS, thereby effects a radial retraction and a tangential swivel of the suction grab SG. As illustrated in FIG. 3, the postal matter P seized by the suction grab SG is radially retracted and withdrawn in tangential direction between the retainer means RE and the remaining stack of the postal matter P and is then moved toward the conveyor means supported by the aforementioned guide means FE.

Figure 4:
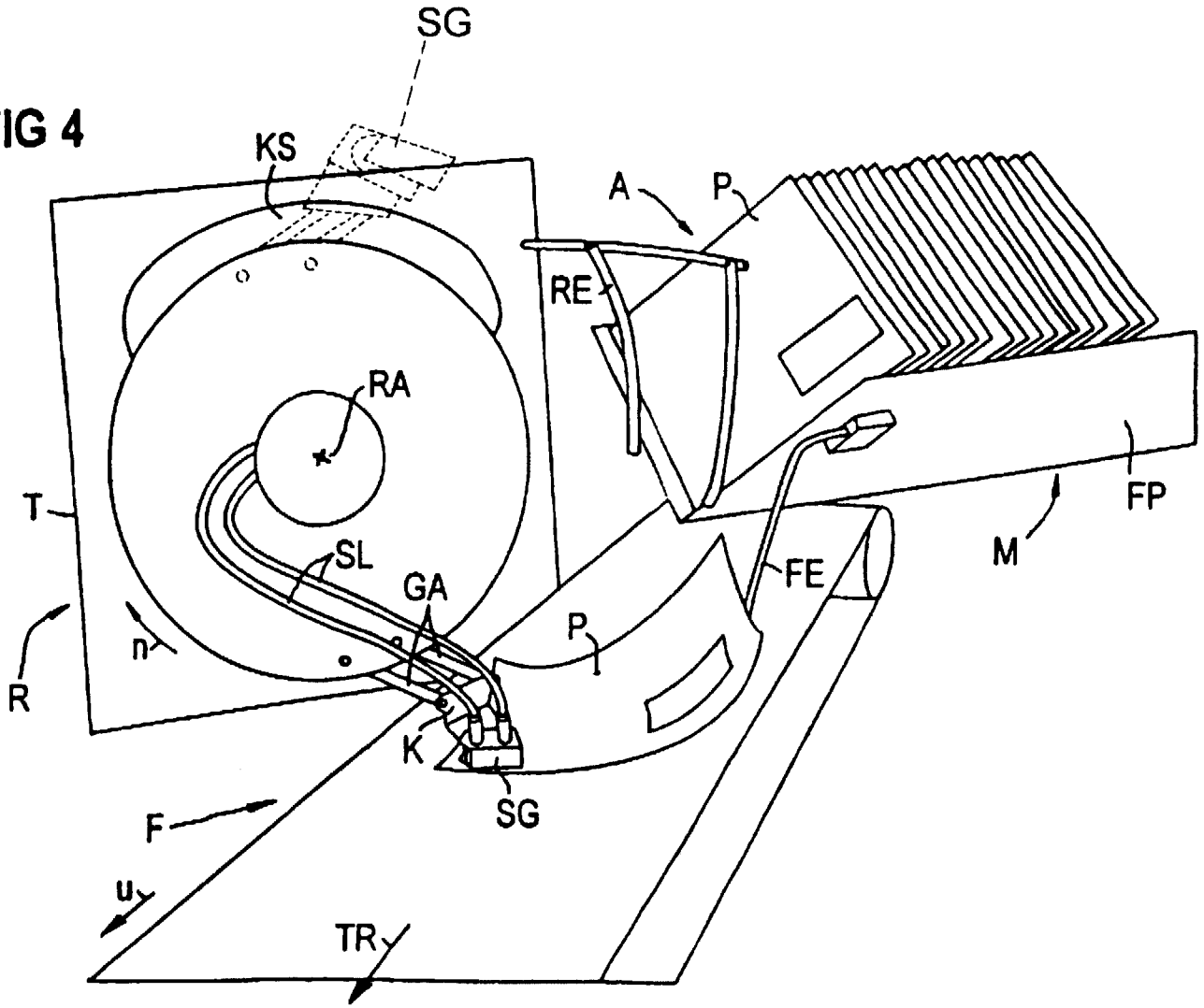
FIG. 4 is a schematic perspective view of the apparatus of FIG. 1 shortly before transferring the letter to a conveyor.

FIG. 4 shows the position of the postal matter P seized by the suction grab SG and sliding down on the guide means FE shortly before being transferred to the conveyor means F. The two articulated arms GA are again completely extended at the moment of the transfer. Moreover, the suction face of the suction grab SG in the transfer position is aligned parallel to the conveying plane of the conveyor means F. By shutting off the vacuum to the two hose conduits SL or by applying a slight over-pressure to the suction units SE, the postal matter P then releases from the suction grab SG and drops onto the conveyor means F in the proper attitude. What is thereby realized by attitudinally correct transfer is an alignment of the postal matter P transversely relative to the conveying direction TR, as shown in FIG. 1 for the preceding transfer event. The speed of the postal matter P in the transfer is approximated to the speed u of the conveyor means F.

The functioning of the separation and transfer of the postal matter P described above with reference to FIGS. 1 through 4 requires that the magazine M, the rotor R and the conveyor means F are correspondingly aligned relative to one another in terms of their spatial position. In the illustrated exemplary embodiment, the guide profile FP is set at an angle of 30° relative to the conveying direction TR and is inclined toward the back by an angle of about 15° relative to the horizontal conveying plane of the conveyor means. The rotor shaft RA is aligned at an angle of 45° relative to the conveying direction TR of the conveyor means F and is inclined toward the back by an angle of 15° relative to the conveying plane of the conveyor means F.

Figure 6:
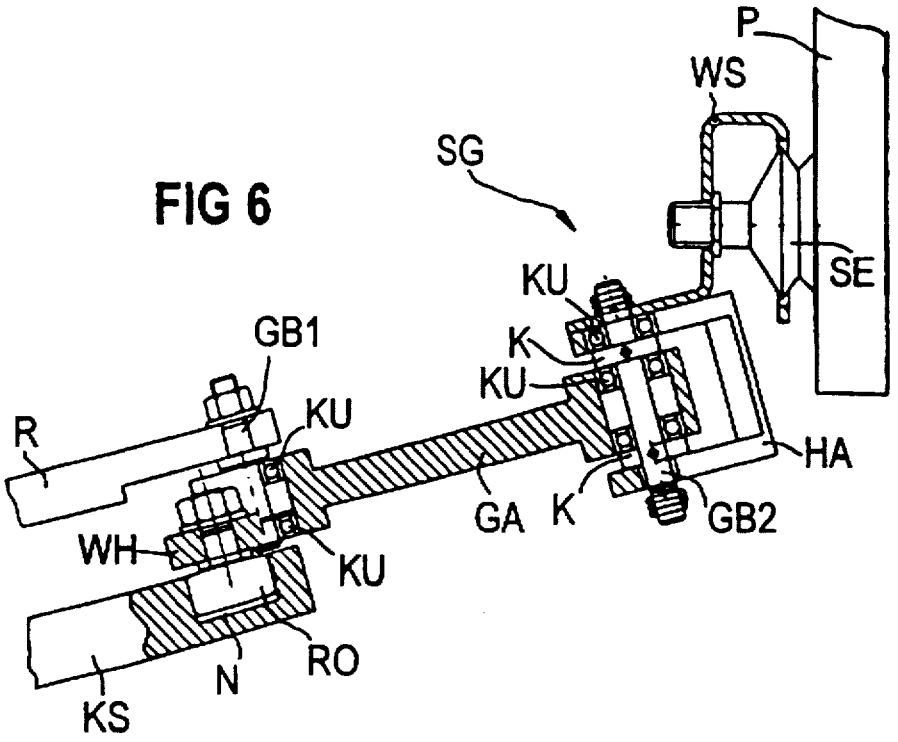
FIG. 6 is a sectional view taken through one of the articulated arms of the linkage of FIG. 5.

FIGS. 5 and 6 show the attachment of the suction grab SG to a four-pin linkage in detail. As was already mentioned in conjunction with FIG. 1, the four-bar linkage includes articulated arms GA of equal length and a coupling K, whereby one of the articulated arms GA is rigidly connected to an angle lever WH. The free end of the angle lever WH carries a roller RO that does not run at the outer circumference but in a channel N of the cam plate KS in the exemplary embodiment shown here.

The four-bar linkage includes a total of four articulation pins GB1, GB2, GB3 and GB4 that are inserted into ball bearings KU of the two articulated arms GA. The two articulation pins GB1 and GB3 are thereby torsionally connected to the rotor R, whereas the two articulation pins GB2 and GB4 are torsionally connected to the coupling K formed by two flat pieces arranged at a distance from one another.

The suction grab SG has two dish-shaped suction units SE attached to a bend WS that are composed of an elastic material and are capable of seizing the postal matter P by the application of the vacuum. The bend WS is connected to a U-shaped holder HA that is in turn arranged swivelable on the articulation pin GB2 of the four-bar chain via ball bearings KU. The U-shaped holder HA and, thus, the entire suction grab SG can thus be swivelled around the articulation pin GB2 relative to the coupling K. This swivel motion, which can be undertaken against the force of a leaf spring BF supported at the articulation pin GB2 and a pin ST, enables a corresponding, resilient angular adaptation of the suction grab SG when pulling rigid postal matter P from the fetching position A of the magazine M (see FIGS. 1 through 4).

In the schematic illustration of FIGS. 1 through 4, the rotor R carries one suction grab SG. For increasing the throughput, the rotor R can, for example, carry four suction grabs SG that, given a uniform division t of the conveyor means F, are secured to the rotor in a uniform circumferential division. For adaptation to a non-uniform division t of the conveyor means F, the circumferential division of the four suction grabs SG at the rotor R can also, for example, amount to 80°, 100°, 80° and 100° once again.

As an illustrative example, FIG. 4 shows one additional suction grab SG in phantom view spaced 180° from the other suction grab SG on the rotor R.

An operator loads the magazine M with stacks of arriving postal matter P. The feed (not shown in FIGS. 1 through 4) of the postal matter P in the direction toward the fetching position A of the magazine M can be undertaken, for example, by leaf-like strips that respectively convey a stack of the postal matter P up in steps, that swivel out in an upper limit position, are moved down, and that are then swivelled back into the guide profile FP. For example, a light barrier arranged at the height of the upper fetching position A is suitable for controlling the feed.

The above-described apparatus for separating and distributing postal matter P leads to a rotating impeller wheel whose cells formed by the individual blades accept the postal matter P arriving on the conveyor means F and, after a corresponding rotation, deliver it to unit load carriers of a sorting means that circulate thereunder. The circulating unit load carriers then in turn convey the postal matter P into sorting containers or sorting bays allocated to the respective postal zip code.

Details of a suitable impeller wheel proceed, for example, from the German Patent Application P 43 44 437.8. Details of a suitable sorting means are presented, for example, in German Patent Applications P 43 23 564.6 and P 43 23 565.4.

Various changes and modifications to the presently preferred embodiments will be apparent to those skilled in the art. Such changes and modifications may be made without departing from the spirit and scope of the present invention and without diminishing its attendant advantages. Therefore, the appended claims are intended to cover such changes and modifications.

What is claimed is:

1. An apparatus for separating and distributing unit loads onto a conveyor, the apparatus comprising:

a magazine adapted for storing and guiding a stack of unit loads such that an endmost unit load of said stack in said magazine is in an upper fetching position, the magazine having a generally L-shaped guide profile and which is fixed in an inclined manner such that the stack lies against two sides of the L-shaped guide profile;

a rotor which is rotatably moveable and which carries at least one suction grab, the suction grab being radially displaceable relative to the rotor and swivellably mounted to the rotor by a linkage, the linkage including two parallel articulated arms of equal length each having one end pivotably mounted to said rotor and another end pivotably mounted to a coupling on which said suction grab is secured, the suction grab being adapted for suctionally grasping said unit load from the fetching position:

a cam drive controlling the relative motion between said coupling and said rotor, wherein the cam drive includes a cam plate which is non-rotatably fixed adjacent the rotatable rotor; and a moveable conveyor located near said magazine onto which said suction grab releases said grasped unit load;

the magazine, rotor and conveyor being positioned relative to one another such that the suction grab can seize the unit load in the fetching position of the magazine and transfer it to the conveyor during a rotation of the rotor.

2. An apparatus according to claim 1, characterized in that the angle between the two sides of the L-shaped guide profile amounts to approximately 90°.

3. An apparatus according to claim 1, further comprising a retainer fixedly mounted relative to the magazine, the retainer being adapted for releasably holding the unit load in the fetching position until it is seized by the suction grab.

4. An apparatus according to claim 1, further comprising a guide fixedly mounted relative to the magazine for guiding the unit load seized by the suction grab between the fetching position and the conveyor.

5. An apparatus according to claim 1, wherein the conveyor is a belt conveyor.

6. An apparatus according to claim 1, wherein the suction grab is mounted to the rotor so that the suction grab is swivellable in tangential direction relative to a direction of rotation of the rotor.

7. An apparatus according to claim 1, wherein at least two suction grabs are mounted to the rotor.

8. An apparatus according to claim 1, wherein the suction grab includes two elastic suction units which seal against and thereby seize the unit load.

9. An apparatus according to claim 1, wherein the cam drive further includes an angle lever secured to one of said articulated arms, and a roller mounted on said angle lever, wherein said roller runs in a channel disposed in the cam plate when said rotor rotates.

10. An apparatus according to claim 1, wherein the cam plate is adjustably secured relative to the rotor.

11. An apparatus according to claim 1, wherein the two articulated arms are generally radially extended relative to said rotor when seizing a unit load in the fetching position.

12. An apparatus according to claim 1, wherein the two articulated arms are generally radially extended relative to said rotor upon transfer of the unit load to the conveyor.

13. An apparatus according to claim 1, wherein the magazine and the rotor are positioned and aligned relative to one another such that, when seizing the unit load, the suction grab has a suction face aligned approximately parallel to a surface of the unit load to be seized.

14. An apparatus according to claim 1, wherein the rotor and the conveyor are positioned relative to one another such that, when transferring the unit load to the conveyor, the suction grab has a suction face aligned approximately parallel to a conveying plane of the conveyor.

15. An apparatus according to claim 11, wherein the magazine and the conveyor are positioned relative to one another to optimize an attitudinally correct transfer of the unit load to the conveyor.

16. An apparatus according to claim 11, wherein the conveyor has a plurality of regular divisions, and wherein a speed of the conveyor and a speed of the rotor are matched to one another such that the transfer of the unit load to the conveyor ensues at a whole multiple of the division of the conveyor.

17. An apparatus according to claim 1, wherein the suction grab is mounted to the rotor so that the suction grab is swivellable in tangential direction relative to a direction of rotation of the rotor.

18. An apparatus for separating and distributing unit loads onto a conveyor, the apparatus comprising:

a magazine adapted for storing and guiding a stack of unit loads such that an endmost unit load of said stack in said magazine is in an upper fetching position, the magazine having a generally L-shaped guide profile and which is fixed in an inclined manner such that the stack lies against two sides of the L-shaped guide profile;

a rotor which carries at least one suction grab and which is rotatably moveable on an axis, the axis being aligned obliquely to a conveying direction of the conveyor, the suction grab being radially displaceable and swivellably mounted relative to the rotor, the suction grab being adapted for suctionally grasping said unit load from the fetching position; and a moveable conveyor located near said magazine onto which said suction grab releases said grasped unit load;

the magazine, rotor and conveyor being positioned relative to one another such that the suction grab can seize the unit load in the fetching position of the magazine and transfer it to the conveyor during a rotation of the rotor.

19. An apparatus according to claim 18, wherein the axis is inclined obliquely relative to a conveying plane of the conveyor.

20. An apparatus according to claim 18 characterized in that the angle between the two sides of the L-shaped guide profile amounts to approximately 90°.

21. An apparatus according to claim 18, further comprising a retainer fixedly mounted relative to the magazine, the retainer being adapted for releasably holding the unit load in the fetching position until it is seized by the suction grab.

22. An apparatus according to claim 18, further comprising a guide fixedly mounted relative to the magazine for guiding the unit load seized by the suction grab between the fetching position and the conveyor.

23. An apparatus according to claims 18, wherein the conveyor is a belt conveyor.

24. An apparatus according to claim 18, wherein at least two suction grabs are mounted to the rotor.

25. An apparatus according to claim 18, wherein the suction grab includes two elastic suction units which seal against and thereby seize the unit load.

26. An apparatus according to claim 18, wherein the magazine and the rotor are positioned and aligned relative to one another such that, when seizing the unit load, the suction grab has a suction face aligned approximately parallel to a surface of the unit load to be seized.

27. An apparatus according to claim 18, wherein the rotor and the conveyor are positioned relative to one another such that, when transferring the unit load to the conveyor, the suction grab has a suction face aligned approximately parallel to a conveying plane of the conveyor.

28. An apparatus according to claim 18, wherein the magazine and the conveyor are positioned relative to one another to optimize an attitudinally correct transfer of the unit load to the conveyor.

29. An apparatus according to claim 18, wherein the conveyor has a plurality of regular divisions, and wherein a speed of the conveyor and a speed of the rotor are matched to one another such that the transfer of the unit load to the conveyor ensues at a whole multiple of the division of the conveyor.

* * * * *